US007052282B2

(12) United States Patent
Meleck et al.

(10) Patent No.: US 7,052,282 B2
(45) Date of Patent: May 30, 2006

(54) CORD SET WITH A BREAKABLE CONNECTOR

(75) Inventors: Michael Meleck, Winnipeg (CA); Gary C. Edwards, Apple Valley, MN (US)

(73) Assignee: Phillips & Temro Industries, Inc., Eden Prairie, MN (US)

( * ) Notice: Subject to any disclaimer, the term of this patent is extended or adjusted under 35 U.S.C. 154(b) by 0 days.

(21) Appl. No.: 10/952,566

(22) Filed: Sep. 28, 2004

(65) Prior Publication Data

US 2006/0068636 A1 Mar. 30, 2006

(51) Int. Cl.
*H01R 33/00* (2006.01)
*H01R 3/00* (2006.01)
*H01R 13/58* (2006.01)

(52) U.S. Cl. ..... 439/34; 439/163; 439/475

(58) Field of Classification Search ..... 439/34, 439/35, 163, 475, 923, 274
See application file for complete search history.

(56) References Cited

U.S. PATENT DOCUMENTS

| | | | | |
|---|---|---|---|---|
| 3,858,140 | A | 12/1974 | Hancock | |
| 4,538,134 | A | 8/1985 | Carey | |
| 4,570,145 | A | 2/1986 | Carey | |
| 4,699,445 | A | 10/1987 | Porta et al. | |
| 5,088,835 | A | 2/1992 | Shigezawa et al. | |
| 5,181,866 | A | 1/1993 | Jerome et al. | |
| 5,188,542 | A | 2/1993 | Ballman | |
| 5,320,563 | A | 6/1994 | Liao | |
| 5,344,330 | A * | 9/1994 | Hoffman | 439/138 |
| 5,384,559 | A | 1/1995 | Shamir | |
| 5,538,439 | A | 7/1996 | Fell et al. | |
| 5,590,010 | A | 12/1996 | Ceola et al. | |
| 5,618,198 | A * | 4/1997 | Sato et al. | 439/274 |
| 5,742,464 | A | 4/1998 | Ceola et al. | |
| 5,777,868 | A | 7/1998 | Gibboney, Jr. | |
| 5,885,098 | A | 3/1999 | Witkowski | |
| 5,921,799 | A * | 7/1999 | Forrester | 439/346 |
| 5,930,097 | A | 7/1999 | Ceola et al. | |
| 5,937,140 | A | 8/1999 | Leonard et al. | |
| 6,010,348 | A * | 1/2000 | Alden | 439/274 |
| 6,036,530 | A | 3/2000 | Edwards et al. | |
| 6,039,602 | A | 3/2000 | Witkowski et al. | |
| 6,072,152 | A | 6/2000 | Landry | |
| 6,171,118 | B1 | 1/2001 | Witkowski et al. | |
| 6,179,654 | B1 | 1/2001 | Witkowski et al. | |

(Continued)

FOREIGN PATENT DOCUMENTS

CA 2135948 5/1996

*Primary Examiner*—Chandrika Prasad
(74) *Attorney, Agent, or Firm*—Harness, Dickey & Pierce, P.L.C.

(57) ABSTRACT

A cord set for connecting a vehicle to a power source includes a first cord having a first connector adapted to be selectively connected to the power source and a second cord having a second connector adapted to be selectively connected to the vehicle. In addition, the cord set includes a coupling mechanism that selectively couples the first cord to the second cord. The coupling mechanism includes a first fitting fixedly attached to the first cord having a plurality of projections and a second fitting fixedly attached to the second cord having a plurality of apertures for matingly receiving the projections of the first fitting. The projections engage the apertures to connect the first fitting to the second fitting under normal operation and disengage the apertures to disconnect the first fitting from the second fitting when the cord set is place under a predetermined tensile force.

21 Claims, 8 Drawing Sheets

U.S. PATENT DOCUMENTS 6,203,354 B1 * 3/2001 Kuwahara et al. ..... 439/357
6,257,923 B1 7/2001 Stone et al.
6,448,863 B1 9/2002 Ogawa et al.

* cited by examiner

CORD SET WITH A BREAKABLE CONNECTOR

FIELD OF THE INVENTION

The present invention relates to power cords and more particularly to an improved connector for a power cord assembly.

BACKGROUND OF THE INVENTION

Many heavy duty trucks include a sleeper cab that provides a driver with a space in which to rest and sleep during regulated hours of service. Such sleeper cabs commonly include household appliances such as televisions, refrigerators, microwave ovens, and heating/air conditioning systems for use by the driver during a typical 10 hour rest period. Each of the appliances require a power source to function and therefore require the driver to provide ample electricity if any of the appliances are to be used.

Generally speaking, a driver can supply power to cab appliances from three sources. A first power supply is provided through operation of a truck engine such that electrical power is generated via an alternator/battery arrangement. Second, an auxiliary power generator or an auxiliary battery bank with an inverter may be used to power the appliances directly. Finally, the driver can supply power to the truck cab by connecting the cab to an external power source.

While connecting appliances such as a heater, refrigerator, or television set directly to a truck battery will certainly provide such appliances with a requisite energy supply, doing so will quickly drain the truck battery. Draining the truck battery is obviously not a viable option as the battery is required to start the truck. Furthermore, powering such appliances from a running truck engine is similarly impracticable. In many states, heavy duty truck engines must be turned off within 3 to 5 minutes once the truck begins to idle (i.e., the engine is running, but the truck is at rest). Most laws penalize drivers who allow their truck engines to continue operation after the 5 minute threshold by imposing large fines and other penalties. Therefore, running a truck engine over an extended period of time to power cab appliances is not a viable option for the truck driver.

Due to the limitations of conventional truck electrical systems and the recent enactment of laws restricting idling time of truck engines in most states, an external power source is a viable option for a truck driver. Thankfully, most states either are starting to provide, or already do provide, such external power sources at truck stops across the country. Therefore, the remaining challenge for the driver is simply connecting the truck cab to the power source.

Most power sources are disposed adjacent to truck parking spaces such that a driver can connect the truck cab to the power source by using an extension cord in order to provide a constant supply of electricity to the cab. Once the extension cord is firmly attached to the power source, the driver connects the other end of the cord into a receptacle mounted to the truck cab to thereby supply the truck cab with electricity.

Conventional extension cords adequately provide the truck driver with the ability to temporarily connect an external power source to a truck cab. However, the length of a typical rest period, combined with the frequency of such stops, results in some truck drivers forgetting to disconnect the extension cord from the external power source prior to pulling out of the parking stop. Due to the large electrical capacity of such extension cords (generally capable of connecting to a 120 VAC grid), the connection at both the external power source and at the truck cab is often very secure to prevent against an inadvertent disconnection at either location. The secure connections, while safely connecting the truck cab to the external power source, do not allow for the cord to be easily pulled from either the truck cab or the power source when a driver inadvertently pulls out from a parking space with the extension cord still attached. The result of such an occurrence is damage to either, or both of, the truck cab and the external power source connection points.

While conventional extension cords adequately provide a truck driver with the ability to supply a constant supply of electricity to a truck cab by connecting the truck cab to an external power source, conventional extension cords suffer from the disadvantage of causing damage to either or both of the truck cab and the external power source if a driver pulls out of a parking space prior to disconnecting the extension cord from the power source and truck cab.

Therefore, an extension cord incorporating a breakable connector that allows for safe disconnection of power between the truck cab and power source in the event that the truck cab is driven from a parking space with the extension cord still attached at both the truck cab and the power source is desirable in the industry.

SUMMARY OF THE INVENTION

A cord set for connecting a vehicle to a power source includes a first cord having a first connector adapted to be selectively connected to the power source and a second cord having a second connector adapted to be selectively connected to the vehicle. In addition, the cord set includes a coupling mechanism that selectively couples the first cord to the second cord. The coupling mechanism includes a first fitting fixedly attached to the first cord having a plurality of projections and a second fitting fixedly attached to the second cord having a plurality of apertures for matingly receiving the projections of the first fitting. The projections engage the apertures to connect the first fitting to the second fitting under normal operation and disengage the apertures to disconnect the first fitting from the second fitting when the cord set is placed under a predetermined tensile force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
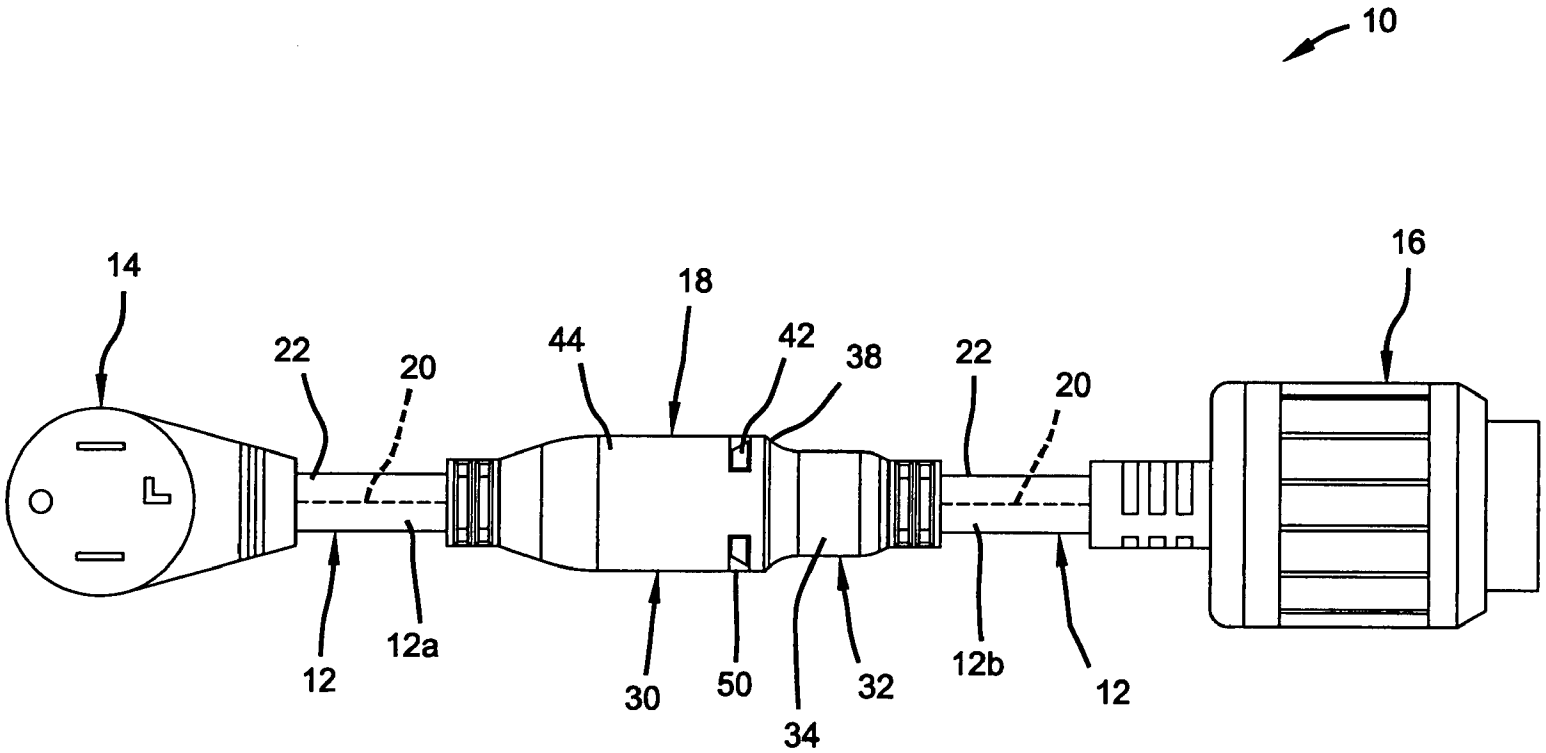
FIG. 1 is a side view of a power cord assembly incorporating a connector in accordance with the principals of the present invention.

With reference to the figures, an extension cord assembly 10 is provided and includes a flexible power cable 12, a power connector 14, a cab connector 16, and a breakable connector 18. The breakable connector 18 is disposed at a predetermined position along the length of the power cable 12, generally between the power connector 14 and cab connector 16, as best shown in FIG. 1. The breakable connector 18 allows the power cable 12 to transmit electrical power between the power connector 14 and cab connector 16 while concurrently providing for selective disconnection between the power connector 14 and cab connector 16 if a predetermined force is applied to the extension cord 10, as will be discussed further below.

The power cable 12 includes cable sections 12*a* and 12*b*, each having a wire 20 encapsulated by a flexible outer cover 22. The flexible outer cover 22 insulates the wire 20, thereby protecting the wire 20 from shorting out and allowing for handling of the extension cord 10 when the power cable 12 is carrying current. The power cable 12 of the present invention is designed for connection to a 120 V power source. Therefore, the cable 12 is generally rated for carrying 100–300 volts AC and up to 50 amps of current. While the cable 12 of the present invention is designed for connection to a 120 V power source, it should be understood that the power rating, and thus the size and weight of the cable 12, can be reduced or enhanced, depending on the particular application and power source to which the cable 12 may be tied. Therefore, while the present invention will be described as associated with a 120 V power source, it should be understood that the connectors 14, 16, 18 could be adapted and used with a cable of greater or lesser weight and should be considered as part of the present invention.

Power cable section 12*a* is fixedly and electrically connected to the power connector 14 such that the cable 12*a* extends between the power connector 14 and the breakable connector 18, as best shown in FIG. 1. The power connector 14 is designed to be releasably attached to an external power source 24 (FIG. 7) such that power supplied by the external power source 24 can be transmitted through the cable 12*a*. In operation, a user inserts the power connector 14 into a receptacle 26 of a power source 24 such that the power connector 14 is electrically connected to the source 24. Once properly attached to the receptacle 26, the power connector 14 receives electrical power from the power source 24 and transmits the power along the power cable 12*a*.

The cab connector 16 is similarly fixedly and electrically attached to power cable section 12*b*, but is disposed at an opposite end of the power cable 12 from the power connector 14. Therefore, the power connector 14 and cab connector 16 are disposed at opposite ends of the extension cord 10 with the breakable connector 18 disposed therebetween, as best shown in FIG. 1. The cab connector 16 is designed to be releasably connected to a truck cab 28 (FIG. 7) such that power supplied to the extension cord 10 at power connector 14 is transmitted to the truck cab 28 via power cables 12*a*,12*b*, breakable connector 18, and cab connector 16, as will be discussed further below.

Figure 2:
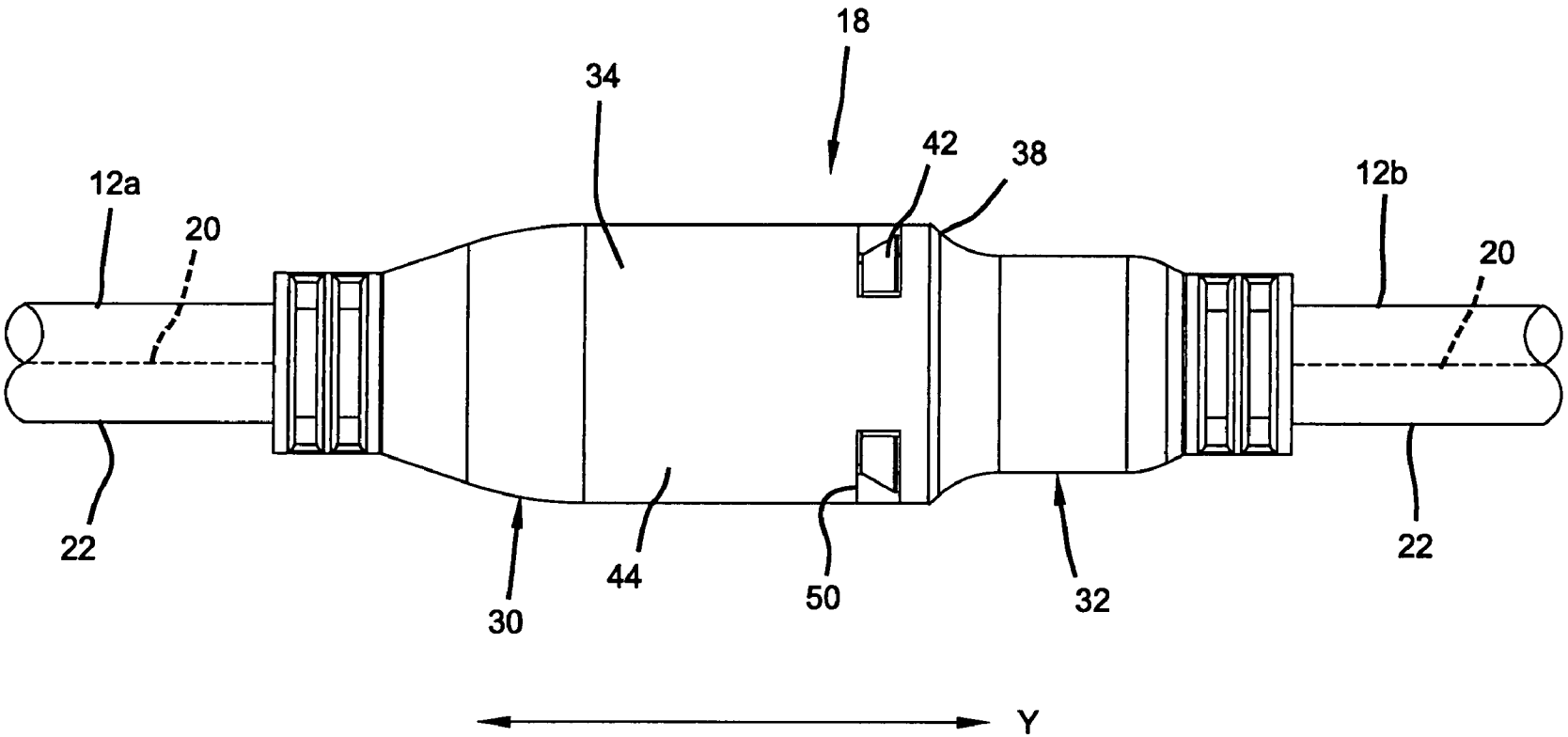
FIG. 2 is a side view of the connector of FIG. 1 in a connected state.
Figure 3:
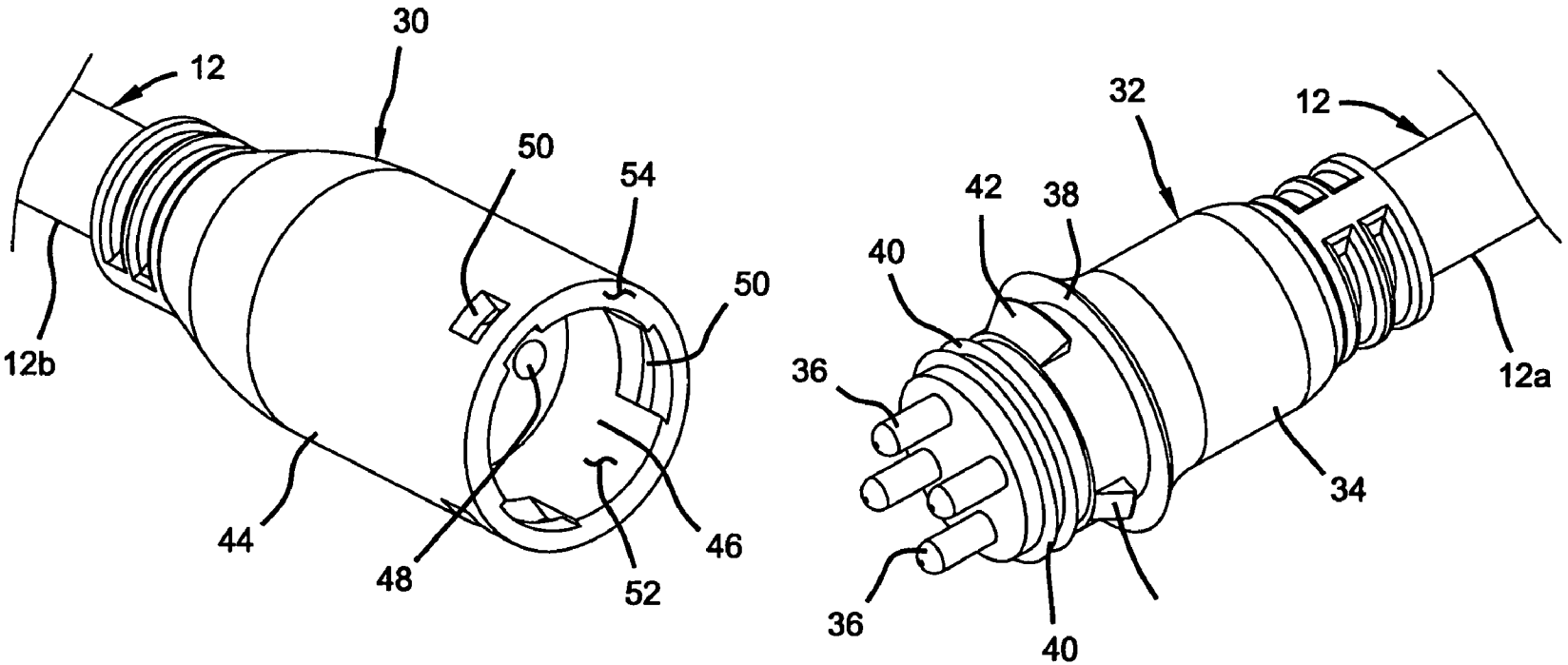
FIG. 3 is a perspective view of the connector of FIG. 1 in a disconnected state.

The breakable connector 18 is disposed generally between the power connector 14 and the cab connector 16 and serves to transmit electrical power received from the power connector 14 to the truck cab 28 via cab connector 16. The breakable connector 18 includes a power fitting 30 and a cab fitting 32, as best shown in FIGS. 2 and 3. The power fitting 30 is fixedly and electrically connected to power cable section 12*a* such that the power fitting 30 is electrically tied to the power connector 14. Similarly, the cab fitting 32 is fixedly and electrically connected to power cable section 12*b* such that the cab fitting 32 is fixedly and electrically connected to the cab connector 16.

The cab fitting 32 includes a main body 34 and a number of current-carrying pins 36. The main body 34 fixedly receives power cable 12*a* and serves to electrically connect the power cable 12*b* with current-carrying pins 36. In addition, the main body 34 includes a flange 38, plurality of circumferential ribs 40, and a series of projections 42. The flange 38 radially extends from the main body 34 and serves as a stop for engagement with the power fitting 30, as will be discussed further below. The ribs 40 are generally positioned between the current-carrying pins 36 and the flange 38, as best shown in FIG. 3. The ribs 40 are axially spaced apart from one another and are integrally formed with the main body 34. The ribs 40 are received by the power fitting 30 such that a weather-proof seal is formed between the power and cab fittings 30, 32.

Figure 4:
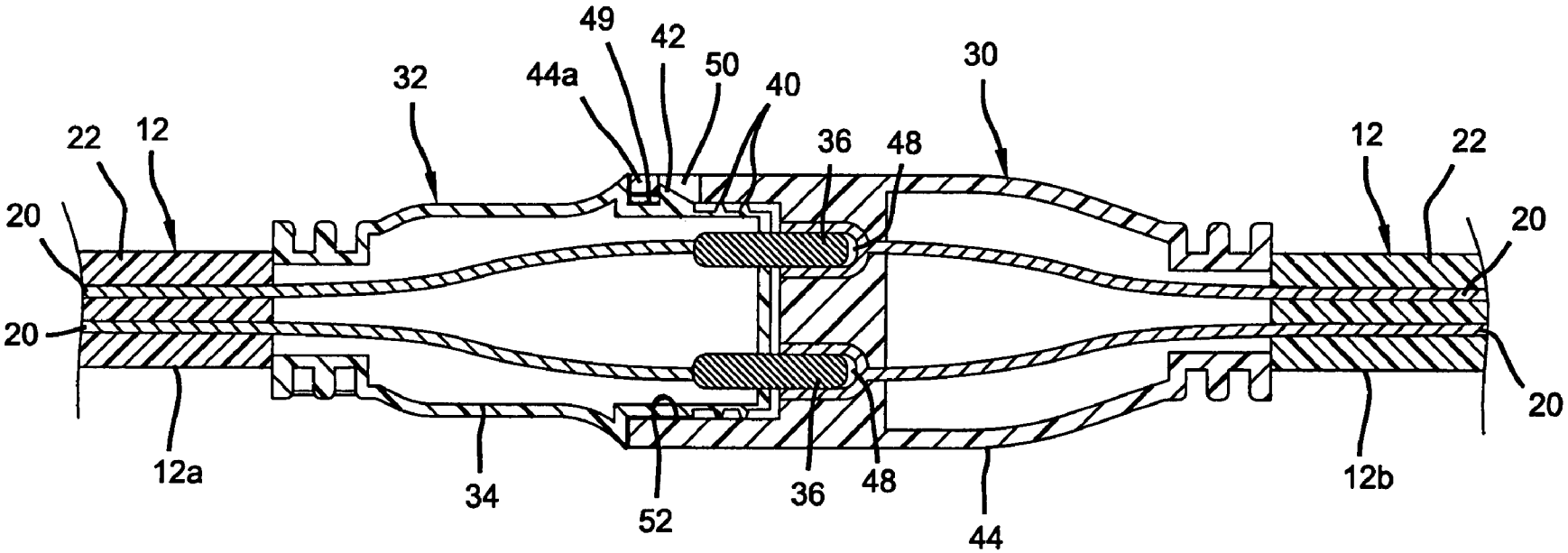
FIG. 4 is a cross-sectional view of the power fitting of the connector of FIG. 1 in a connected state.
Figure 5A:
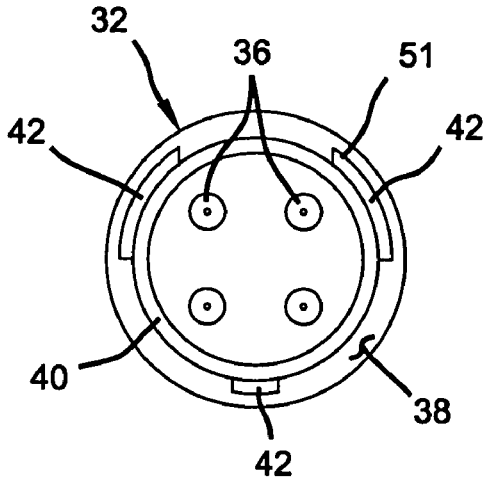
FIG. 5*a* is a front view of a cab fitting in accordance with the principals of the present invention.
Figure 5B:
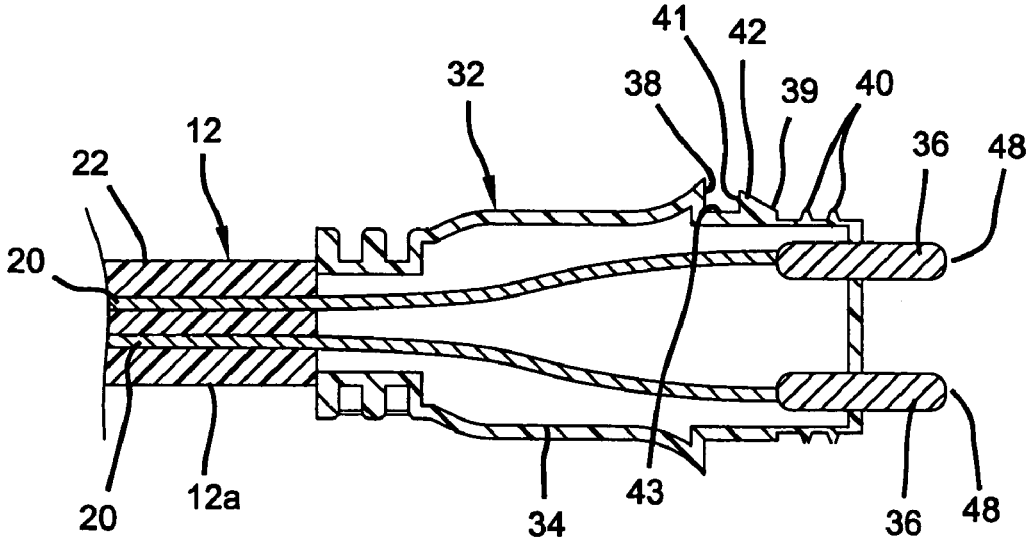
FIG. 5*b* is a cross-sectional view of the cab fitting of FIG. 5*a;*

The projections 42 are integrally formed with the main body 34 and radially extend therefrom. The projections 42 are spaced apart in a circumferentially equally spaced apart pattern and include an insertion surface 39 and a back surface 41. A recess 43 is disposed generally adjacent to the back surface 41, as best shown in FIGS. 4 and 5*b*. The projections 42, in combination with the current-carrying pins 36 and axial ribs 40, serve to releasably attach the cab fitting 32 to the power fitting 30 such that the power cable sections 12*a*, 12*b* are electrically connected. The projections 42 are matingly received by the power fitting 30 such that the cab fitting 32 is releasably secured to the power fitting 30. As shown in FIGS. 3 and 5*a*, one of the three projections 42 is smaller in size than the other two projections 42. The smaller projection 42 serves to help a user properly align the cab fitting 32 with the power fitting 30 to ensure an electrical connection having the proper polarity between the power cables 12*a*, 12*b*.

The overall number and size of the projections 42 can be altered to tailor a force required to separate the cab fitting 32 from the power fitting 30. For example, by including a smaller projection 42 and two larger projections 42, the force required to separate the fittings 30, 32 can be reduced when compared to a similar connector having three large projections 42. While three projections 42 are disclosed, it should be understood that any number of projections, incorporating a plurality of shapes and sizes, could alternately be used to weaken or strengthen the connection between the fittings 30, 32, depending on the particular application of the extension cord 10. In addition to varying the overall number and size of the projections 42, the geometry of each projection 42 can be tailored to provide a desired separation force required to disconnect the cab fitting 32 from the power fitting 30, as will be discussed further below.

Figure 6A:
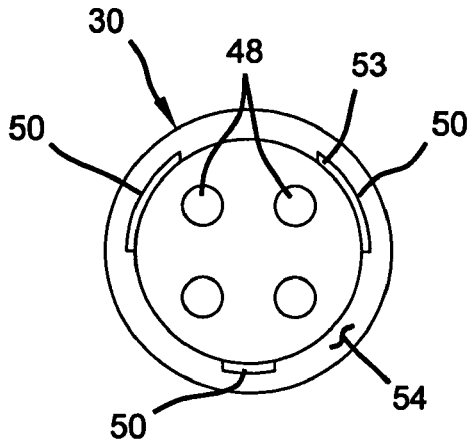
FIG. 6*a* is a front view of a power fitting in accordance with the principals of the present invention.
Figure 6B:
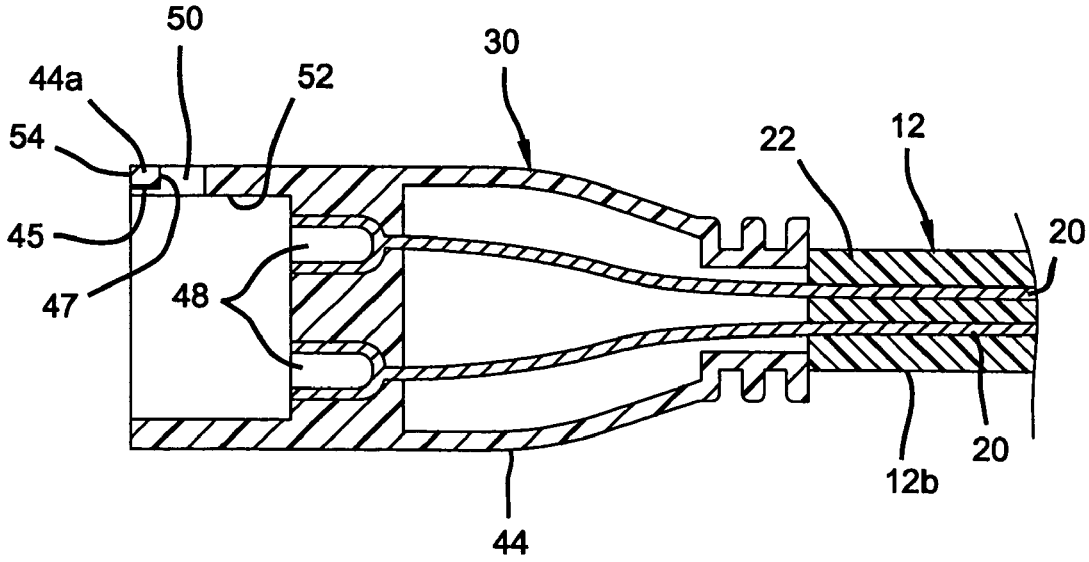
FIG. 6*b* is a cross-sectional view of the power fitting of FIG. 6*a;*

The power fitting 30 includes a main body 44 having a receptacle 46, electrical sockets 48, and a series of projection apertures 50 integrally formed therewith, as best shown in FIGS. 3, 6*a*, and 6*b*. In addition, the power fitting 30 includes a groove 45 disposed adjacent to each aperture 50 and a lock surface 47. The main body 44 fixedly receives power cable 12*a* and serves to electrically connect the power cable 12*a* with electrical sockets 48. In addition, the main body 44 releasably receives the cab fitting 32 such that the ribs 40 engage an inner surface 52 of the receptacle 46 and the flange 38 abuts an end surface 54.

When the connection between the power and cab fittings 30, 32 is made, the insertion surface 39 of the projection 42 engages the groove 45 of the cab fitting 32 to help facilitate insertion of the projection 42 into the aperture 50. As can be appreciated, the generally sloped nature of the insertion surface 39 cooperates with the recessed groove 45 to help ease insertion of the cab fitting 32 into the power fitting 30 such that less force is required to engage projections 42 with their respective apertures 50.

Once the insertion surface 39 has sufficiently traveled along the groove 45, the back surface 41 of the projection engages the lock surface 47 of the aperture 50 to releasably hold the power fitting 30 and cab fitting 32 together. In this manner, the projection 42 is disposed generally within aperture 50 such that the groove 45 opposes recess 43, creating a gap 49 therebetween. At this point, a portion of the main body 44*a* extends into the recess 43 such that the end surface 54 engages the flange 38 and the lock surface 47 engages the back surface 41, as best shown in FIGS. 5*b* and 6*b*.

Interaction between the inner surface 52 of the cab fitting 32 and the ribs 40 provides a weather-proof seal between the respective fittings 30, 32. In other words, the seal between the power fitting 30 and the cab fitting 32 created through the interaction between the ribs 40 and the inner surface 52 of the receptacle 46 restricts water from reaching a connection between the current-carrying pins 36 and the electrical sockets 48. At this point, the projections 42 are seated within apertures 50 and flange 38 abuts end surface 54 of the main housing 44 to ensure that the current-carrying pins 36 are fully and matingly received by the electrical sockets 48 to create an electrical connection between power cables 12*a*, 12*b*.

The engagement between the power fitting 30 and the cab fitting 32 is designed to withstand a 20 to 40 lb axial force applied to the extension cable 10. In other words, small forces (i.e., generally less than 20 lbs.) will not cause the projections 42 to disengage the projection apertures 50 and allow the cab fitting 32 to separate from the power fitting 30. However, if a larger force is applied to the extension cord 10 (i.e., generally greater than 20 lbs.), the projections 42 will compress and disengage the projection apertures 50, thereby allowing the cab fitting 32 to separate from the power fitting 30.

The separation force required to separate the power fitting 30 and the cab fitting 32 can be tailored based on the geometry of both the projections 42 and the apertures 50. Specifically, to increase the force required to separate the power fitting 30 and the cab fitting 32, the engagement between the back surface 41 and the lock surface 47 can be increased such that each projection 42 is seated deeper into each aperture 50. Conversely, to decrease the force required to separate the power fitting 30 and the cab fitting 32, the engagement between the back surface 41 and the lock surface 47 can be decreased such that each projection 42 only extends partially into each aperture 50.

In addition to adjusting the depth of each projection 42, an angle of back surface 41 can be adjusted such that the force required to separate the power fitting 30 and cab fitting 32 is increased or decreased. For example, FIG. 4 shows the back surface 41 as having a substantially 90° angle relative to the main body 34. In this position, the back surface 41 is generally parallel to the lock surface 47, thereby maximizing the resistance to separation between the power and cab fittings 30, 32. To reduce the separation force, the angle of back surface 41 is simply increased relative to the main body 34. The angle of the back surface 41 can be adjusted substantially between 90° and 140°, depending on the desired separation force and application of the extension cord 10.

In addition to adjustments to the depth of the projections 42 and angle of the back surface 41, the junction between the groove 45 and the lock surface 47 can be adjusted to increase or decrease the separation force required to separate the power fitting 30 from the cab fitting 32. Specifically, the depth of the groove 45 can be increased to decrease the separation force or can be decreased to increase the requisite separation force. As shown in FIGS. 5*a* and 6*a*, each projection 42 can include a generally arcuate surface 51 that engages a mating arcuate surface 53 of aperture 50. The arcuate surfaces 51, 53 improve the ability to align the respective fittings 30, 32 and contribute to increasing the required separation force.

It should be noted that any of the foregoing modifications to the geometry of the projections 42 or apertures 50 can be used independently or in combination to tailor the separation force required to disconnect the power fitting 30 from the cab fitting 32.

In the embodiment depicted, approximately half of a force applied to the extension cord 10 is transmitted through engagement between the current-carrying pins 36 and the electrical sockets 48. The remaining force is transmitted through engagement between the ribs 40 and the receptacle and by the engagement between the projections 42 and the projection apertures 50. The magnitude of force transmitted through engagement between the pins 36 and the electrical sockets 48 is generally fixed as the size and shape of the pins 36 is typically dictated by the power requirements of the cable 12. Therefore, because the pin design is usually a constant, and further because the force transmitted by the ribs 40 is relatively small, the design of the projections 42 and projections apertures 50 must be tailored to adjust the ability of the breakable connector 18 to withstand a predetermined axial force.

Figure 7:
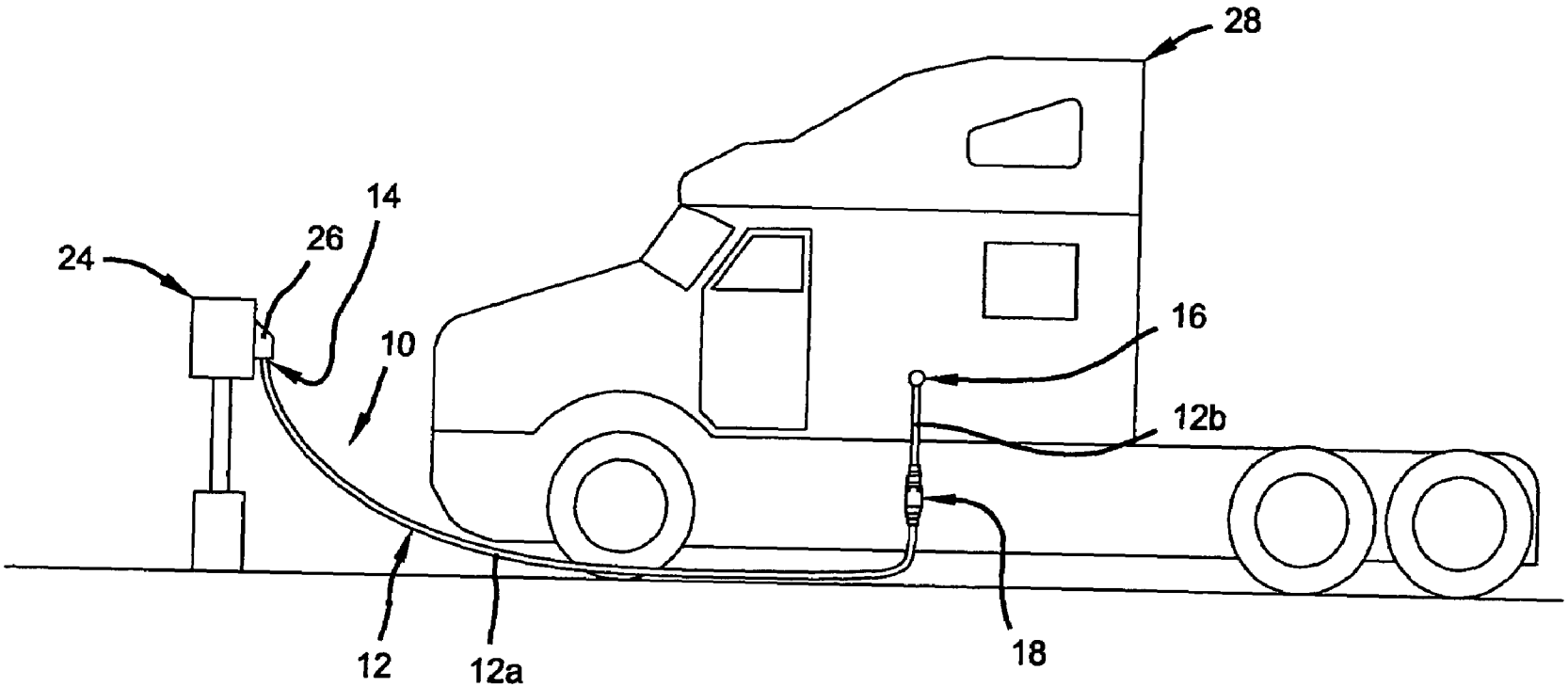
FIG. 7 side view of the power cord assembly of FIG. 1 in a connected state and attached to a truck cab and a power outlet.
Figure 8:
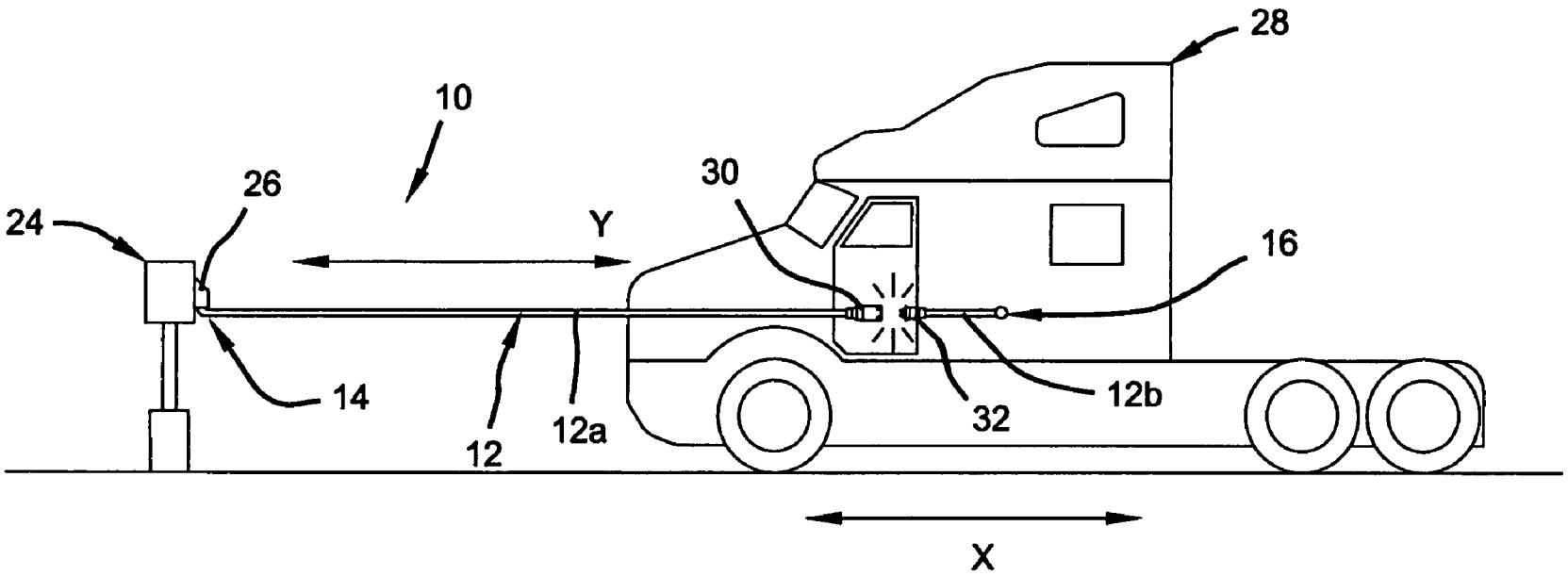
FIG. 8 is a side view of the power cord assembly of FIG. 1 in a disconnected state and partially attached to a truck cab and a power outlet.

With particular reference to FIGS. 7 and 8, the extension cord and breakable connector 18 are shown in use with the power source 24 and truck cab 28. The extension cord 10 is attached at the power source 24 through the interaction between the power connector 14 and the receptacle 26 of the power source 24. Extension cord 10 is attached to the truck cab 28 via the cab connector 16, as previously discussed.

Under normal circumstances, the respective power cables 12*a*, 12*b* are electrically connected by the breakable connector 18 through connection of the current-carrying pins 36 and the electrical sockets 48. Therefore, when the power and cab fittings 30, 32 are connected, electrical power is continuously supplied from the power source 24 to the truck cab 28 via extension cord 10, as shown in FIG. 4.

Prior to moving the truck cab 28, the extension cord 10 should first be disconnected from the power source 24 and from the side of the cab 28. To accomplish this task, the power and cab connectors 14, 16 are disconnected and the extension cord 10 is stored prior to movement of the truck 28. However, in the event that a driver forgets to disconnect the extension cord 10 from the power source 24 and truck cab 28, the breakable connector 18 will prevent damage to the power source 24, truck cab 28, or extension cord 10.

When a driver moves the truck 28 away from the power source 24 in a direction "X" with the extension cord 10 still connected to the power source 24 and to the cab 28, the extension cord 10 is placed under tension, as best shown in FIG. 7. The tensile force applied to the extension cord 10 is applied generally along the length of the cable 12 and perpendicular to the connection between the power and cab fittings 30, 32 as represented by arrow "Y" in FIGS. 2 and 8.

Due to the relationship between the power and cab fittings 30, 32, the breakable connector 18 will disconnect cable 12*a* from cable 12*b* prior to damage being caused to either the power connector 14 or cab connector 16. Specifically, the cab fitting 32 will separate from the power fitting 30 prior to experiencing a great enough force to cause damage to the power connector 14, cab connector 16, or extension cord 10 due to the relationship between the projections 42 and projection apertures 50, as previously discussed.

Once the truck cab 28 has sufficiently moved away from the power source 24 such that the force applied to the breakable connector 18 has severed the cab fitting 32 from the power fitting 30, cable 12*a* will remain connected to the power source 24 and cable 12*b* will remain connected to the cab 28. At this point, the extension cord 10, power source 24, and truck cab 28 have not been damaged due to the efforts of the breakable connector 18.

Placement of the breakable connector 18 along the length of the power cable 12 is important in preventing damage to the cable 12*a* once the cab fitting 32 is severed from the power fitting 30. The breakable connector 18 should be spaced apart from the cab connector 16 a distance to ensure that the cab fitting 32 is not in danger of being run over by the truck 28 once the power fitting 30 is disconnected from the cab fitting 32. It should be noted, however, that the breakable connector 18 must also be sufficiently spaced apart from the cab fitting 32 to allow the connector 18 to be placed under tension when the truck 28 pulls away from the power source 24 while still connected by the extension cord 10 (i.e., so the force applied to the breakable connector 18 is applied in the direction Y of FIGS. 2 and 8). For most truck cabs 28, placement of the breakable connector 18 within 1 to 2 feet from the cab connector 16 ensures protection of the connector 18 once the cab fitting 32 is disconnected from the power fitting 30 and proper orientation when a tensile load is applied to the extension cord 10.

It should be appreciated that breakable connector 18 is reusable after cab fitting 32 has been separated from power fitting 30. A user may re-assemble extension cord 10 by simply aligning projections 42 with projection apertures 50 and applying compressive force. Projections 42 will engage projection apertures 50 in a snap-fit arrangement as previously described. Current of a proper polarity will once again flow between power connector 14 and cab connector 16. The breakable connector 18 is therefore able to securely and releasably attach the truck cab 28 to the power source 24 while concurrently protecting the power source 24, truck cab 28, and extension cord 10 if the truck 28 is inadvertently moved away from the power source 24 with the extension cord 10 still attached to the power source 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cord set for connecting a vehicle to a power source, the cord set comprising:

a first cord having a first end and a second end, said first end having a first connector adapted to be selectively connected to the power source;

a second cord having a first end and a second end, said first end having a second connector adapted to be selectively connected to the vehicle; and a coupling mechanism operable to selectively couple said first cord to said second cord, said coupling mechanism comprising:

a first fitting fixedly attached to said second end of said first cord, said first fitting including a projection radially extending therefrom; and a second fitting fixedly attached to said second end of said second cord, said second fitting including an aperture for matingly receiving said projection;

wherein said projection is operable to enter said aperture in a snap-fit arrangement to connect said first fitting to said second fitting, said projection being operable to disconnect from said second fitting when the cord set is placed under a predetermined tensile force.

2. The cord set of claim 1, wherein said first fitting further includes a plurality of radially extending and axially spaced apart ribs, said ribs being operable to engage said second fitting to create a sealed connection therebetween.

3. The cord set of claim 1, wherein said first fitting includes a plurality of current-carrying pins, said current-carrying pins being matingly received by apertures formed in said second fitting to transmit electricity between said first and second fittings.

4. The cord set of claim 1, wherein said first fitting includes a plurality of projections, wherein at least one of said projections includes a different geometry than other projections of said plurality of projections to facilitate insertion of said first fitting into said second fitting and to orient said fittings thereby providing the correct electrical polarity.

5. The cord set of claim 1, wherein said first fitting includes a flange operable to engage said second fitting to properly position said first fitting relative to said second fitting.

6. The cord set of claim 1, wherein said predetermined tensile force is approximately between 20 and 40 lbs.

7. The cord set of claim 1, wherein a force required to disconnect said first connector from the power source is greater than said predetermined force.

8. The cord set of claim 1, wherein a force required to disconnect said second connector from the vehicle is greater than said predetermined force.

9. The cord set of claim 4, wherein said second fitting includes a plurality of apertures spaced apart from one another for matingly receiving said plurality of projections.

10. The cord set of claim 1, wherein said first fitting can be re-connected to said second fitting after said first fitting is disconnected from said second fitting.

11. A cord set for connecting a vehicle to a power source, the cord set comprising:

a first cord having a first end and a second end, said first end having a first connector adapted to be selectively connected to the power source;

a second cord having a first end and a second end, said first end having a second connector adapted to be selectively connected to the vehicle; and a coupling mechanism operable to selectively couple said first cord to said second cord, said coupling mechanism comprising:

a first fitting fixedly attached to said second end of said first cord and including a housing having a plurality of sealing ribs extending radially outwardly from said housing, a plurality of projections extending radially outwardly from said housing, and a plurality of current-conducting pins, said plurality of projections including at least one projection having a different geometry than others of said plurality of projections; and a second fitting fixedly attached to said second end of said second cord and including a housing having a first plurality of apertures and a second plurality of apertures, said first plurality of apertures matingly receiving said plurality of projections and said second plurality of apertures matingly receiving said current-conducting pins;

wherein said projections are adapted to engage said first plurality of apertures to connect said first fitting to said second fitting and are adapted to disconnect from said first plurality of apertures when the cord set is placed under a predetermined tensile force.

12. The cord set of claim 11, wherein said predetermined force is approximately between 20 and 40 lbs.

13. The cord set of claim 11, wherein a force required to disconnect said first connector from the power source is greater than said predetermined force.

14. The cord set of claim 11, wherein a force required to disconnect said second connector from the vehicle is greater than said predetermined force.

15. The cord set of claim 11, wherein said second fitting includes a bore integrally formed therewith, said bore matingly receiving said ribs to form a seal between said first fitting and said second fitting.

16. The cord set of claim 11, wherein said second fitting is disposed approximately 1 to 2 feet from said second connector.

17. The cord set of claim 11, wherein said first fitting can be re-connected to said second fitting after said first fitting is disconnected from said second fitting.

18. A method of interconnecting a vehicle and a power source, the method comprising:

connecting a first end of a cord set to the power source;

connecting a second end of said cord set to the vehicle;

moving the vehicle away from the power source with said cord set still connected to the power source and to the vehicle;

placing the cord set under tension due to movement of the vehicle relative to the power source; and disconnecting a breakable connector positioned between said first and second ends of said cord set when a predetermined tensile force is experienced by the cord set.

19. The method of claim 18, wherein said predetermined force is less than a force required to disconnect the cord set from the power source.

20. The method of claim 18, wherein said predetermined force is less than a force required to disconnect the cord set from the vehicle.

21. The method of claim 18, further including moving the vehicle closer to the power source and re-connecting the breakable connector such that the power can be supplied to the vehicle from the power source via the cord set.

* * * * *